US006622819B2

(12) United States Patent
Reynolds

(10) Patent No.: US 6,622,819 B2
(45) Date of Patent: Sep. 23, 2003

(54) SOUND ATTENUATOR FOR PNEUMATIC EXHAUST

(76) Inventor: Steven M. Reynolds, 1175 Harlan Rd., Lucas, OH (US) 44843-9702

( * ) Notice: Subject to any disclaimer, the term of this patent is extended or adjusted under 35 U.S.C. 154(b) by 126 days.

(21) Appl. No.: 09/977,762

(22) Filed: Oct. 15, 2001

(65) Prior Publication Data

US 2003/0070870 A1 Apr. 17, 2003

(51) Int. Cl.[7] ..... B21J 35/00

(52) U.S. Cl. ..... 181/230; 181/238; 181/249; 181/264; 181/277

(58) Field of Search ..... 181/249, 212, 181/264, 277, 230

(56) References Cited

U.S. PATENT DOCUMENTS

| | | | | | |
|---|---|---|---|---|---|
| 771,070 | A | * | 9/1904 | Hewitt | 181/277 |
| 879,583 | A | * | 2/1908 | Pratt | 181/269 |
| 1,109,702 | A | * | 9/1914 | Reetz | 181/277 |
| 1,289,750 | A | * | 12/1918 | Hauman | 181/277 |
| 2,198,021 | A | | 4/1940 | Wood | |
| 3,507,353 | A | | 4/1970 | Murphy | |
| 3,561,561 | A | | 2/1971 | Trainor | |
| D220,165 | S | | 3/1971 | Trainor | |
| 3,779,340 | A | | 12/1973 | Hoffman et al. | |
| 4,079,809 | A | * | 3/1978 | Visnapuu et al. | 181/230 |
| 4,316,523 | A | | 2/1982 | Boretti | |
| 4,341,283 | A | | 7/1982 | Mazzanti | |
| 4,749,058 | A | | 6/1988 | Trainor | |
| 5,500,494 | A | | 3/1996 | Ligman | |
| 5,909,016 | A | | 6/1999 | Sterling | |

* cited by examiner

*Primary Examiner*—Kimberly Lockett
(74) *Attorney, Agent, or Firm*—Rankin, Hill, Porter & Clark LLP

(57) ABSTRACT

The present invention provides a sound attenuator for pneumatic exhaust that includes a body having an open end and an inner cavity defined by an inner wall, an inlet port provided in the body adapted to establish fluid communication between a source of pneumatic exhaust and the inner cavity, a cap releasably connected to the body to cover the open end, at least one exit port in fluid communication with the inner cavity, a plurality of baffles arranged within the inner cavity so as to define a series of sequential closed chambers between the inlet port and the exit port, and a deflector proximal to the exit port, the deflector redirecting the flow of pneumatic exhaust at least 90° and cooperating with an exterior surface of the body to define an expansion zone. Each of the baffles has a periphery in contact with the inner wall and is adapted to flex under a predetermined pneumatic pressure load to permit the pneumatic exhaust to flow between the periphery and the inner wall of the body. A sound attenuator according to the invention attenuates the sound of pneumatic exhaust to safe levels, will not clog or plug easily, does not create excessive back pressure, resists freezing and icing, and provides a controlled discharge pattern of pneumatic exhaust.

20 Claims, 6 Drawing Sheets

SOUND ATTENUATOR FOR PNEUMATIC EXHAUST

FIELD OF THE INVENTION

The present invention provides a sound attenuator for pneumatic exhaust.

BACKGROUND OF THE INVENTION

Sound attenuators are used to reduce the noise produced by pneumatic exhaust discharged from various devices such as, for example, air operated diaphragm pumps, pneumatically powered piston or plunger pumps, air cylinders, pneumatic directional control valves, and air motors. Conventional sound attenuators typically include a housing containing porous media such as wrapped or rolled layers of metal or plastic screens and/or other filter materials that control the rate of expansion of the decompressing pneumatic exhaust. Such conventional sound attenuators may also include one or more rigid baffles or fins that force the pneumatic exhaust to flow in tortuous paths within the housing before exiting the housing through a plurality of slits or openings. Conventional sound attenuators of this type are disclosed in, for example, Trainor, U.S. Pat. No. 3,561,561, and Boretti, U.S. Pat. No. 4,316,523.

Those of skill in the art will readily appreciate that conventional sound attenuators for pneumatic exhaust tend to clog easily and/or become plugged during use for a variety of reasons. For example, the rapidly decompressing gas can lead to the formation of ice on various surfaces within the sound attenuator. Ice crystals can clog or plug pathways within a conventional sound attenuator resulting in a decrease in the efficiency and capacity and/or a complete plugging of the device. For this reason, conventional sound attenuators also typically include a pressure relief means such as a blow-out plug to allow for the venting of pneumatic exhaust in the event of a clog or plug. It will be appreciated that if the sizing of the pressure relief means is not sufficient to handle the volume and/or pressure of pneumatic exhaust and/or system fluid (i.e., pumped product) presented, a catastrophic failure of the sound attenuator device or the pneumatic device can occur. In either event (i.e., the blow-out plug operates or a catastrophic failure of one or both of the devices), pneumatic exhaust and, in some cases, system fluid can be discharged into the environment in an uncontrolled and non-sound attenuated manner.

Another problem presented by conventional sound attenuators is that the use of porous filter media to control the rate of expansion also tends to create excessive back pressure, which can reduce the operational efficiency of the pneumatic device. Moreover, it is difficult to maintain a constant back pressure using conventional sound attenuators because of their tendency to become progressively clogged over time.

Another limitation in conventional sound attenuator designs is that pattern of the pneumatic exhaust discharged from such devices is generally random in nature like a sprinkler. Thus, the pneumatic exhaust exiting the sound attenuator is discharged in many directions, which can adversely affect the work environment in the affected area surrounding the sound attenuator.

A sound attenuator is needed that can effectively attenuate the noise produced by pneumatic exhaust while also providing the least amount of constant back pressure necessary for the efficient operation of the pneumatically powered device. Such a sound attenuator should not clog or freeze easily, and should not adversely affect the work environment surrounding the equipment on which it is installed.

SUMMARY OF THE INVENTION

The present invention provides a sound attenuator for pneumatic exhaust that attenuates the sound of pneumatic exhaust to safe levels, does not easily clog or plug, does not create excessive back pressure, resists freezing and icing, and provides a controlled discharge pattern of pneumatic exhaust. The sound attenuator according to the invention can be used to attenuate the sound of pneumatic exhaust from air operated diaphragm pumps, pneumatically powered piston or plunger pumps, air cylinders, pneumatic directional control valves, air motors, and any other type of device or equipment providing a source of pneumatic exhaust.

A sound attenuator according to the invention comprises a body having an open end and an inner cavity defined by an inner wall. An inlet port is provided in the body. The inlet port is adapted to establish fluid communication between a source of pneumatic exhaust and the inner cavity. A cap is releasably connected to the body to cover the open end. The sound attenuator further comprises at least one exit port in fluid communication with the inner cavity. A plurality of baffles are arranged within the inner cavity so as to define a series of sequential closed chambers between the inlet port and the exit port. A deflector is positioned proximal to the exit port to redirect the flow of pneumatic exhaust at least 90°. The deflector cooperates with an exterior surface of the body to define an expansion zone. Each of the baffles has a periphery in contact with the inner wall and is adapted to flex under a predetermined pneumatic pressure load to permit the pneumatic exhaust to flow between the periphery and the inner wall of the body.

In the preferred embodiment of the invention, the sound attenuator further comprises a diffuser that is mounted to the exterior side of the body. The diffuser has an ellipsoidal-section surface portion that is positioned proximal to the deflector to redirect the flow of pneumatic exhaust passing through the expansion zone at least 90°. The diffuser also preferably comprises a finger portion in contact with the exterior surface of the body that can be positioned with respect to the deflector to adjust the dimensions of the expansion zone.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

The present invention may be readily described by reference to the accompanying drawings, in which.

DETAILED DESCRIPTION OF PREFERRED EMBODIMENTS

Figure 1:
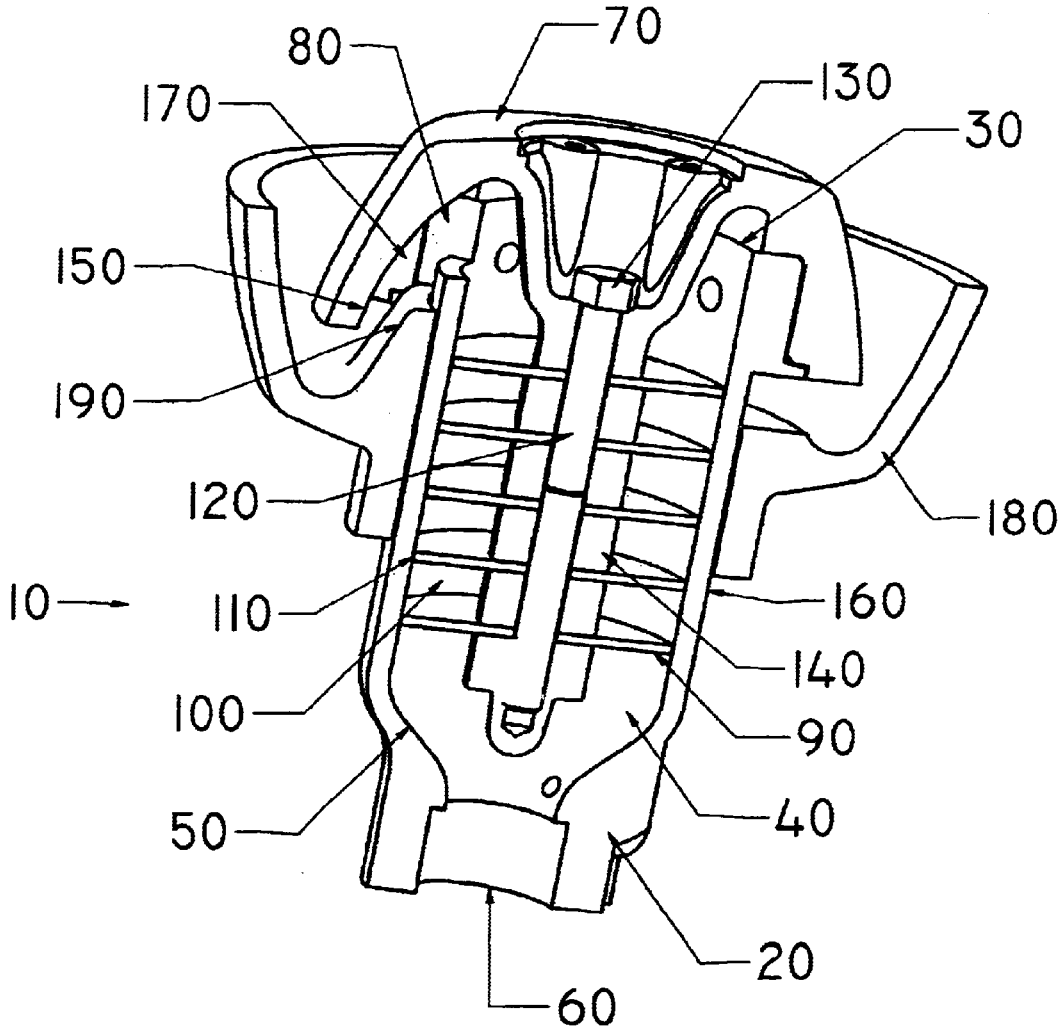
FIG. 1 is a cross-sectional view of one embodiment of a sound attenuator for pneumatic exhaust according to the invention.
Figure 2:
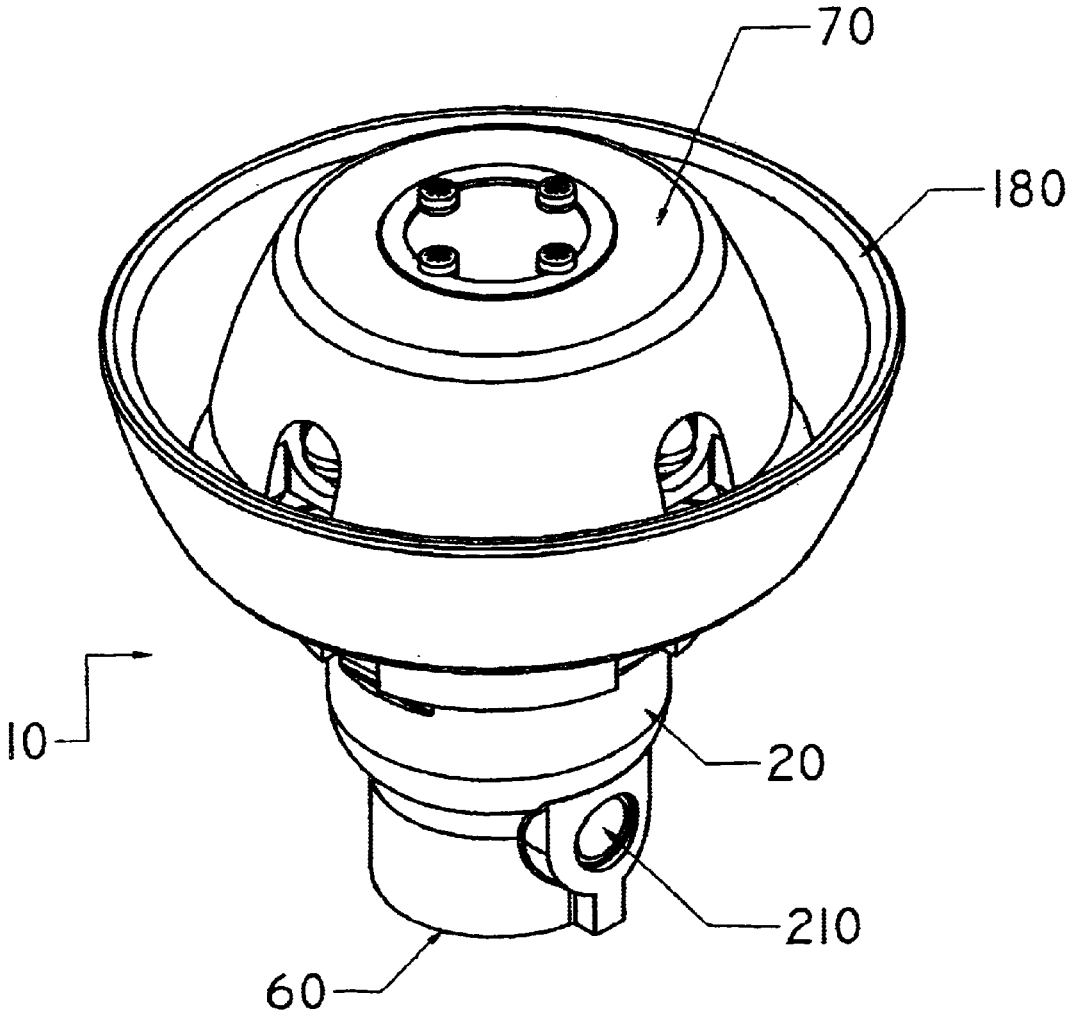
FIG. 2 is a perspective view of another embodiment of a sound attenuator for pneumatic exhaust according to the invention.
Figure 3:
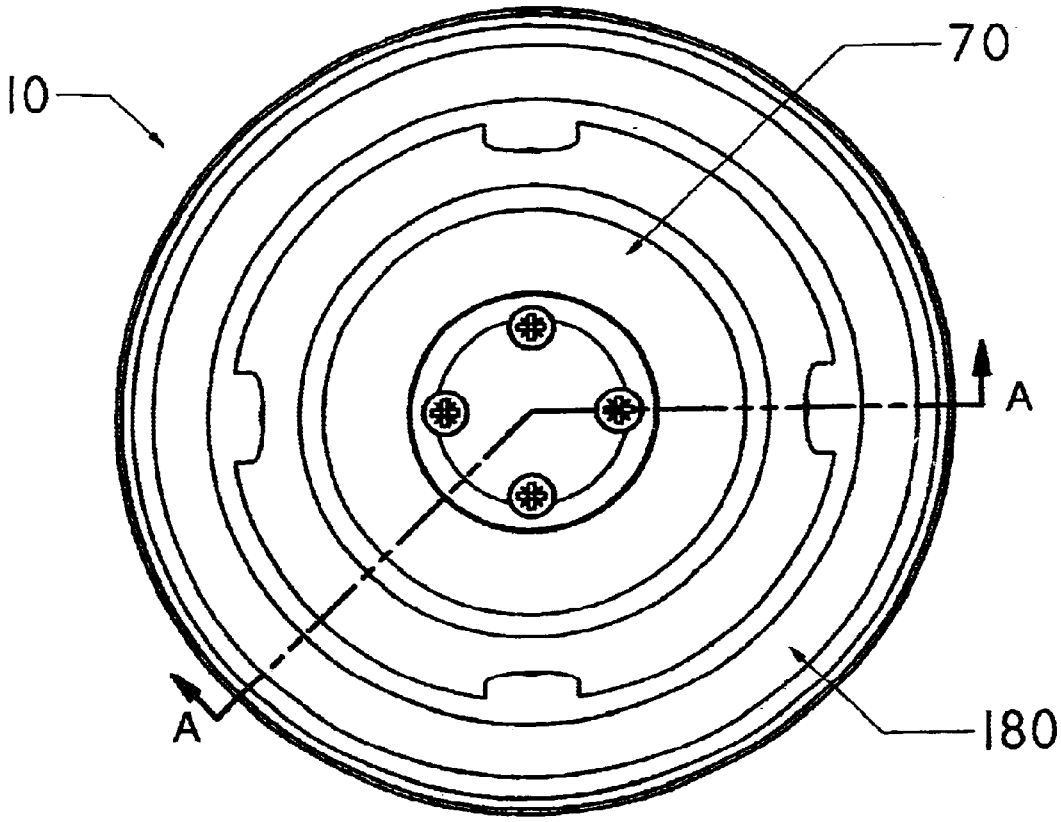
FIG. 3 is a top plan view of the sound attenuator shown in FIG. 2.

Referring more particularly to the accompanying drawings using reference numerals, FIG. 1 discloses a sound attenuator 10 for pneumatic exhaust comprising a body 20 having an open end 30 and an inner cavity 40 defined by an inner wall 50. The body is preferably formed of a substantially rigid material such as plastic or metal, but could be formed of other materials including ceramics.

An inlet port 60 is provided in the body 20. The inlet port 60 is adapted to establish fluid communication between a source of pneumatic exhaust and the inner cavity 40 of the body 20. In a preferred embodiment of the invention, the inlet port 60 is provided with internal threads that mate with external threads on a pipe or tube conveying pneumatic exhaust from the source. It will be appreciated, however, that other means of attachment can be employed. Furthermore, the sound attenuator can be integrally formed as part of a pneumatically powered device, in which case the configuration and location of the inlet port will be determined by the source of pneumatic exhaust. One of skill in the at will readily appreciate that the size of the inlet port and type of connection used will be dictated in large part by the particular application, with the size and type being selected according to the work to be performed and the configuration of the pneumatically powered device the sound attenuator is to be used with.

A cap 70 is connected to the body 20 to cover the open end 30. The cap 70 can be permanently affixed to the body 20 using adhesives or other means, but more preferably is releasably connected to the body 20 so as to permit access to the inner cavity 40. In the embodiment of the invention illustrated in FIG. 1, the cap 70 is threadedly connected to the body 20. However, in other embodiments of the invention such as disclosed in FIGS. 2–6, the cap 70 is connected to the body 20 using screws. It will be appreciated that the means of attaching the cap 70 to the body 20 is not per se critical, and any of the known means of attaching parts together can be employed.

A sound attenuator 10 according to the invention further comprises at least one exit port 80, and more preferably a plurality of exit ports 80, that are in fluid communication with the inner cavity 40. Each of the embodiments of the invention shown in FIGS. 1–7 include a total of four exit ports 80. The exit ports 80 can be formed in the body 20, the cap 70, or more preferably, between the body 20 and the cap 70 as illustrated in FIG. 1.

A plurality of baffles 90 are arranged within the inner cavity 40 of the body 20 so as to define a series of sequential closed chambers 100 between the inlet port 60 and the exit port(s) 80. Each of the baffles 90 has a periphery 110 in contact with the inner wall 50 of the body 20. The baffles 90 are adapted to flex under a predetermined pneumatic pressure load to permit pneumatic exhaust to flow between the periphery 110 and the inner wall 50 of the body 20. The baffles 90 are preferably formed of rubber, synthetic elastomers, or blends thereof.

Figure 6:
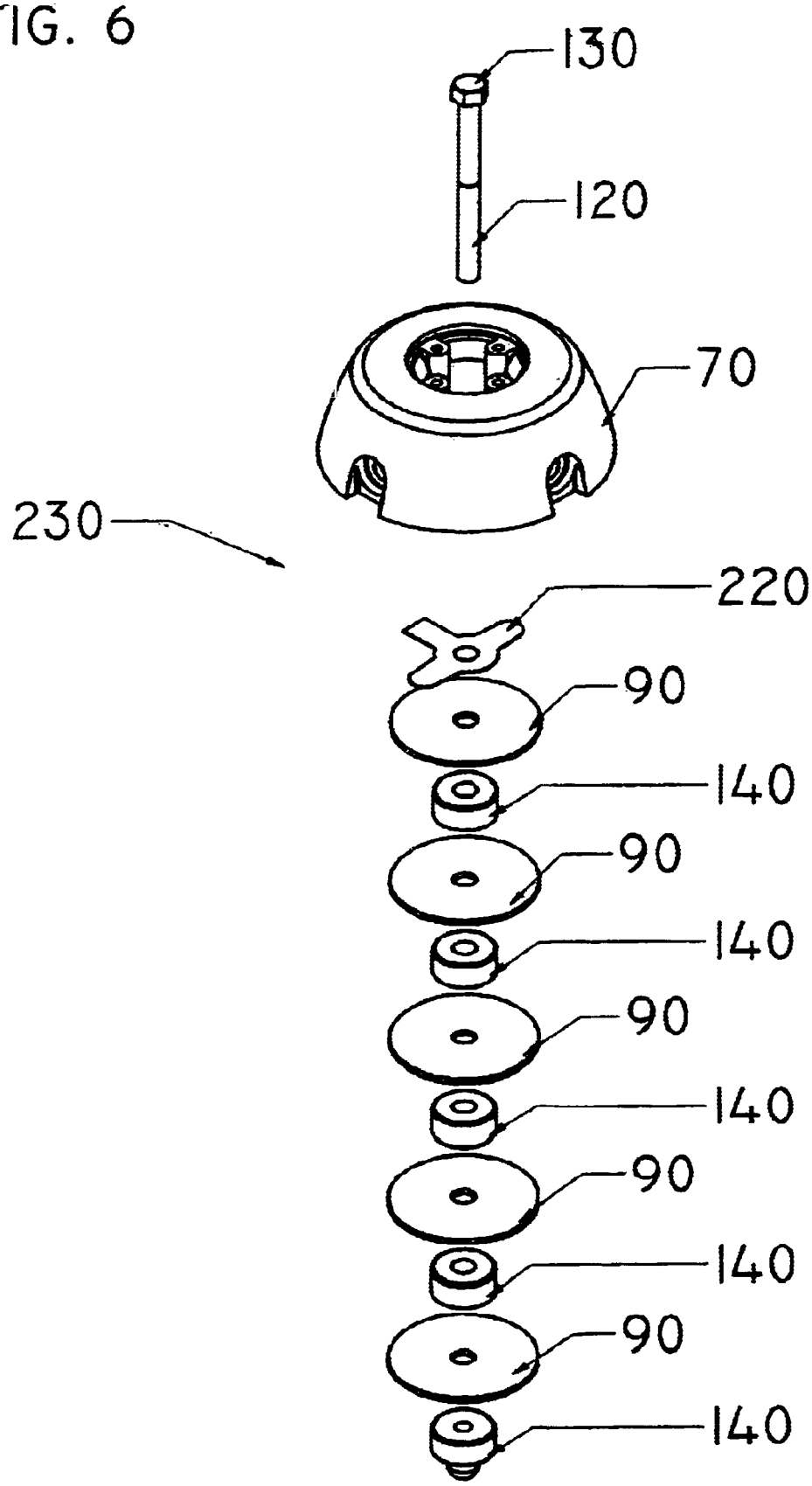
FIG. 6 is an exploded perspective view of a portion of the sound attenuator shown in FIG. 5.

In the preferred embodiment of the invention, the inner wall 50 defines a cylinder and each of the baffles 90 comprises a circular disk. With reference to FIG. 6, the baffles 90 can be axially mounted on a shaft 120 or other support structure that is mounted to the cap 70. In the embodiment illustrated in FIG. 6, the shaft 120 is a threaded shaft of a bolt 130. The baffles 90 are separated by spacers 140 that determine the volume of the chambers 100 formed within the inner cavity 40. Alternatively, the baffles 90 and spacers 140 can be formed as an integral unit. It will be appreciated that chambers 100 having different volumes can be formed using spacers 140 of differing widths.

The baffles cause the pneumatic exhaust to decompress and expand in a gradual, controlled manner as it passes through the inner cavity. The expansion rate of the pneumatic exhaust is primarily controlled by the location and flexibility of the baffles, which define a series of sequential closed chambers between the inlet port and the exit port(s). Each baffle flexes to allow pneumatic exhaust to pass between its periphery and the inner wall of the inner cavity under a predetermined pneumatic pressure load. The spacing of the baffles, which defines the volume of each sequential chamber, as well as the flexibility of the baffles, which defines the pressure loading that must be met before the baffle flexes, determine the rate at which the pneumatic exhaust is permitted to pass through the inner cavity.

The spacing between the baffles may, but need not be, identical within the sound attenuator. Similarly, the thickness and/or composition of the baffles may, but need not be, identical within the sound attenuator. It will be appreciated that the rate of decompression and flow of pneumatic exhaust through the sound attenuator can be readily adjusted and controlled via the selection of the number of baffles employed, the thickness of the various baffles used, the durometer (hardness) of such baffles, the material from which the baffles are constructed, and the spacing between the baffles within the inner cavity.

The flexing motion of the baffles together with the flow of pneumatic exhaust between the periphery of the baffles and the inner wall retards the formation and adhesion of ice crystals within the sound attenuator. Thus, a sound attenuator according to the present invention will not become clogged with ice when operated under the same conditions that would completely clog or block a conventional sound attenuator with ice. Similarly, the flexible baffles used in a sound attenuator according to the present invention allow for the passage and discharge of any ice crystals that may form in and become discharged from the pneumatically powered equipment on which the sound attenuator is being used. A sound attenuator according to the invention advantageously provides a substantially unrestricted pathway from the pneumatically powered device to the atmosphere, with the size and flexibility of the baffles, the diameter of the inner cavity, and the size of the exit port(s) being the only limits on the size of ice and or other debris that can pass through the sound attenuator. The substantially unrestricted pathway through a sound attenuator according to the invention provides over-pressurization protection without the need for conventional pressure relief means such as blow-out plugs.

A sound attenuator 10 according to the invention further comprises a deflector 150 proximal to each exit port 80. The deflector 150 redirects the flow of pneumatic exhaust exiting the inner cavity 40 at least 90°, and more preferably as close as possible to about 180°. The redirection of the exiting pneumatic exhaust continues the process of controlling the expansion rate of the compressed gas by lengthening the column or zone in which the gas continues to expand and also serves to assist in the attenuation of sound waves by changing their direction.

In a preferred embodiment of the invention, the deflector 150 cooperates with an exterior surface 160 of the body 20 to define an expansion zone 170, and the sound attenuator 10 further comprises a diffuser 180 mounted to the exterior surface 160 of the body 20. The diffuser 180 has an ellipsoidal-section surface portion 190 positioned proximal to the deflector 150 that redirects the flow of pneumatic exhaust passing through the expansion zone 170 at least 90°, and more preferably as close as possible to about 180°. Again, the redirection of the exiting pneumatic exhaust continues the process of controlling the expansion rate of the compressed gas by lengthening the column or zone in which the gas continues to expand and also serves to assist in the attenuation of sound waves by changing their direction.

Not only does the diffuser serve to redirect the sound pressure waves of the exhaust air to further attenuate sound levels, it also directs the path of the exiting exhaust air away from the source of pneumatic exhaust. Conventional sound attenuators typically have a random "sprinkler head" discharge pattern. In the event of a failure of a pneumatic device such as a pump, product or process fluid can be pumped through the sound attenuator. Conventional sound attenuators with "sprinkler head" discharge patterns tend to spray the product or process fluids over a wide area whereas the controlled discharge pattern defined by the diffuser in a sound attenuator according to the invention reduces such problems.

To provide adjustability, the diffuser 180 can further comprises a finger portion 190 that is in contact with the exterior surface 160 of the body 20. The finger portion 190 can thus be positioned with respect to the deflector 150 to adjust the dimensions of the expansion zone 170. Positioning of the finger portion 190 with respect to the deflector 150 can be accomplished manually or by automated means (e.g., motor driven). If desired, the diffuser 180 can be mounted to the exterior surface 160 of the body 20 in the desired position using a set screw 200 or any other suitable attachment means.

The finger portion of the diffuser can be used to externally adjust the back pressure produced by the sound attenuator so as to maximize the operating conditions of the pneumatically powered device on which the sound attenuator is installed. For example, manufacturers of air operated diaphragm pumps typically publish a maximum allowable positive suction head pressure. Pressures exceeding this published maximum can cause damage to the pump by increasing differential pressure across the diaphragm. In such applications, it is advantageous to control the differential pressure by restricting the pump's exhaust air to a pressure equal to the positive suction head pressure. In conventional applications, differential pressure is typically controlled through the use of pipe fittings and some means of restriction such as a ball, needle, or gate valve in the exhaust port of the pump. A conventional sound attenuation device is then typically installed onto the exit port of that fabricated back pressure assembly. It will be appreciated that all the pieces required for this type of setup must be sized, sourced, procured, and assembled onto the pump. The resultant assembly can be unwieldy and prone to damage. A sound attenuator according to the present invention advantageously facilitates the adjustment and tuning of back pressure externally via the positioning of the finger portion of the diffuser thereby eliminating the need for additional parts and/or special equipment.

Preferably, the body 20, cap 70, and diffuser 180 are each formed of plastic. However, it will be appreciated that one or more of such parts can be formed of other materials such as, for example, metals, composites, and ceramics. In some applications, it is advantageous to form the sound attenuator from materials that can withstand high temperatures. In other applications, it is advantageous to form the sound attenuator from materials that are corrosion resistant. In other applications, it is advantageous to form the sound attenuator from conductive materials in order to dissipate static electricity. It will be appreciated that the selection of specific materials used to fabricate the body 20, cap 70, and diffuser 180 will made in view of the environment and conditions in which the sound attenuator will be expected to operate, as well as cost.

Figure 4:
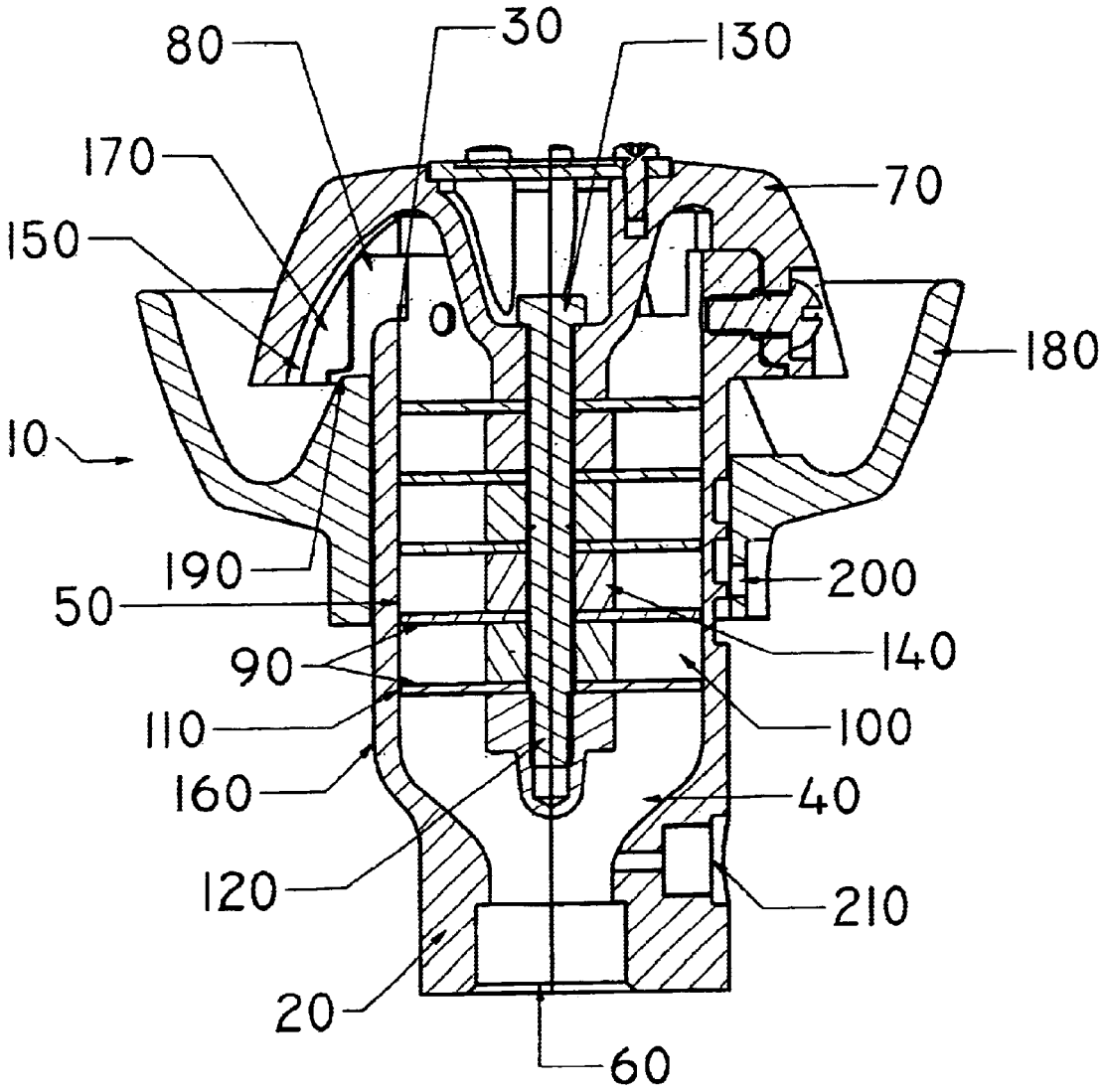
FIG. 4 is a cross-sectional view of the sound attenuator shown in FIG. 2 taken along the plane indicated by A—A in FIG. 3.

With reference to FIG. 4, a sound attenuator 10 according to the invention can further comprise a gauge port 210 provided in the body 20. The gauge port 210 can be provided at virtually any location in the body 20, but is particularly useful for measuring back pressure when provided in the body 20 between the inlet port 60 and the baffles 90.

Also, with reference to FIG. 6, a sound attenuator 10 according to the invention can further comprise a piezoelectric film sensor 220 mounted to at least one of the plurality of baffles 90. The flexing of the baffle causes the piezoelectric film sensor 220 to produce an electric output signal that can be processed to accurately measure device performance and/or specific conditions within the sound attenuator such as, for example, the flow rate of pneumatic exhaust through the sound attenuator.

As noted above, the piezoelectric film sensor can be used to measure a variety of conditions. For example, when utilized on a piece of equipment that has a pulsating pneumatic exhaust output (e.g., a reciprocating pump), the signal from the piezoelectric film sensor can be used to count strokes and/or to measure the speed of operation of the device. The time interval between pulses can also be measured to determine speed of operation and/or flow rate of the equipment. Signals from the piezoelectric film sensor can be processed to determine the volume of product being pumped, can be used as a signal to operate ancillary equipment in proper concert with the pump, and/or to simply to determine the amount of time the pump has operated between scheduled maintenance periods. Moreover, the mere presence of an output signal can be used to verify the sound attenuator is operational.

The output signal from a piezoelectric film sensor can also be used to "sense" the degree of deflection of the baffles. These measurements can be used to assist in adjusting the performance of the sound attenuator by providing data from which it can be determined whether less flexible baffles ought to be used, whether larger or smaller spacers ought to be used, and/or to assist in making other determinations that are important in terms of safety, reliability, and efficiency. The interpretation of the sensor signal output coupled with known or obtainable characteristics of the equipment utilized allows for an almost unlimited application of programmable logic specific to the equipment's application and/or utilization.

Figure 5:
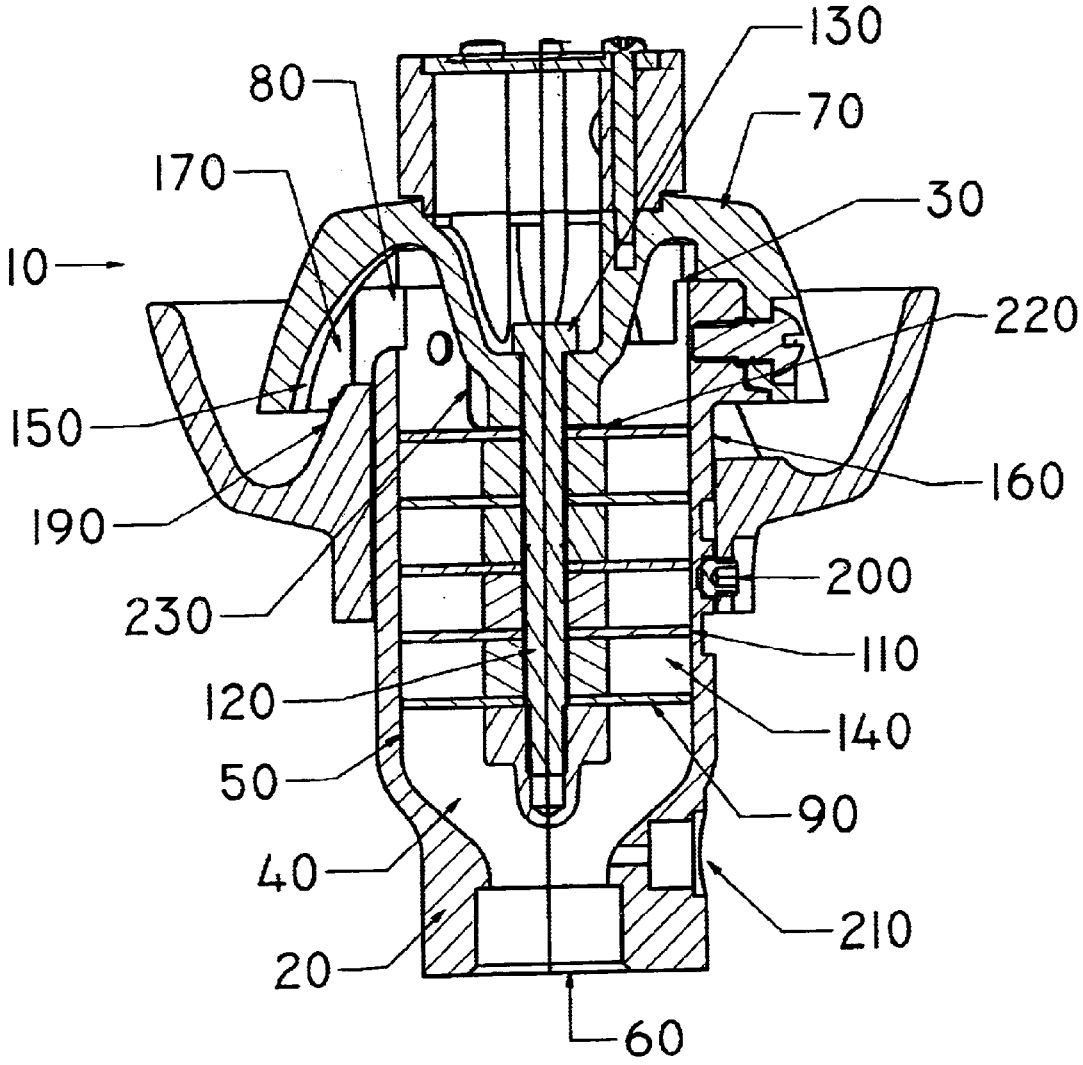
FIG. 5 is a cross-sectional view of another embodiment of a sound attenuator according to the invention.

The output signal form the piezoelectric film sensor is preferably routed out of the sound attenuator assembly using a sensor lead 230 that passes through the cap 70 as illustrated in FIG. 5. The sensor lead 230 terminates in a conventional manner allowing for an end-user selected interface, which are well-known in the art.

Additional advantages and modifications will readily occur to those skilled in the art. Therefore, the invention in its broader aspects is not limited to the specific details and illustrative embodiments shown and described herein. Accordingly, various modifications may be made without departing from the spirit or scope of the general inventive concept as defined by the appended claims and their equivalents.

What is claimed:

1. A sound attenuator for pneumatic exhaust comprising:

a body having an open end and an inner cavity defined by an inner wall;

an inlet port provided in said body adapted to establish fluid communication between a source of pneumatic exhaust and said inner cavity;

a cap connected to said body to cover said open end;

at least one exit port in fluid communication with said inner cavity;

a plurality of baffles arranged within said inner cavity so as to define a series of sequential closed chambers between said inlet port and said exit port, each of said baffles having a periphery in contact with said inner wall, said baffles being adapted to flex under a predetermined pneumatic pressure load to permit said pneumatic exhaust to flow between said periphery and said inner wall; and a deflector proximal to said exit port, said deflector redirecting the flow of pneumatic exhaust at least 90°.

2. The sound attenuator according to claim 1 wherein said cap is threadedly connected to said body.

3. The sound attenuator according to claim 1 wherein said baffles are formed from natural rubber, synthetic elastomers, or blends thereof.

4. The sound attenuator according to claim 1 having a plurality of exit ports formed between said body and said cap.

5. The sound attenuator according to claim 1 wherein said inner wall defines a cylinder and each of said baffles comprises a circular disk.

6. The sound attenuator according to claim 5 wherein said baffles are axially mounted on a shaft and are separated by spacers.

7. The sound attenuator according to claim 6 wherein said baffles and said spacers formed as an integral unit.

8. The sound attenuator according to claim 6 wherein said shaft is anchored to said cap.

9. The sound attenuator according to claim 6 wherein said at least two of said spacers are of differing widths.

10. The sound attenuator according to claim 1 wherein said deflector cooperates with an exterior surface of said body to define an expansion zone, and wherein said sound attenuator further comprises a diffuser mounted to said exterior surface of said body, said diffuser having an ellipsoidal-section surface portion positioned proximal to said deflector to redirect the flow of pneumatic exhaust passing through said expansion zone at least 90°.

11. The sound attenuator according to claim 10 wherein said diffuser further comprises a finger portion in contact with said exterior surface of said body, said finger portion being positionable with respect to said deflector to adjust the dimensions of said expansion zone.

12. The sound attenuator according to claim 11 wherein said diffuser is positionable manually or by automated means.

13. The sound attenuator according to claim 10 wherein said body, cap, and diffuser are formed of plastic.

14. The sound attenuator according to claim 1 further comprising a gauge port provided in said body.

15. The sound attenuator according to claim 14 wherein said gauge port is provided in said body between said inlet port and said baffles for measuring back pressure.

16. The sound attenuator according to claim 1 further comprising a piezoelectric film sensor mounted to at least one of said baffles.

17. The sound attenuator according to claim 16 wherein said piezoelectric film sensor produces an output signal for device performance.

18. A sound attenuator for pneumatic exhaust comprising:

a body having an open end and an inner cavity defined by a cylindrical inner surface;

an inlet port provided in said body adapted to establish fluid communication between a source of pneumatic exhaust and said inner cavity;

a cap releasably connected to said body to cover said open end;

a plurality of exit ports formed between said cap and said body;

a plurality of baffles arranged within said body so as to define a series of sequential closed chambers between said inlet port and said exit ports, each of said baffles comprising a circular disk having a periphery in contact with said inner surface of said body, said disks being adapted to flex under a predetermined pneumatic pressure load to permit said pneumatic exhaust to flow between said periphery and said inner surface, said disks being axially mounted on a shaft and separated by spacers, said shaft being anchored to said cap;

a plurality of deflectors formed in said cap, each of said deflectors being positioned proximal to an exit port, said deflectors redirecting the flow of pneumatic exhaust at least 90° and cooperating with an exterior surface of said body to define an expansion zone; and a diffuser mounted to an exterior surface of said body, said diffuser having an ellipsoidal-section surface portion positioned proximal to each of said deflectors to redirect the flow of pneumatic exhaust passing through said expansion zones at least 90°, said diffuser further comprising a plurality of finger portions in contact with said exterior surface of said body, each of said finger portions being positionable with respect to one of said deflectors to adjust the dimensions of a corresponding expansion zone.

19. The sound attenuator according to claim 18 further comprising a gauge port provided in said body.

20. The sound attenuator according to claim 19 further comprising a piezoelectric film sensor mounted to at least one of said disks.

* * * * *